US005410942A

United States Patent [19]

Begneu

[11] Patent Number: 5,410,942

[45] Date of Patent: May 2, 1995

[54] PERCUSSION IGNITION DEVICE FOR A MORTAR OR THE LIKE AND A MORTAR COMPRISING SUCH A DEVICE

[75] Inventor: Michel Begneu, Bourges, France

[73] Assignee: Giat Industries, Versailles, France

[21] Appl. No.: 987,289

[22] PCT Filed: Feb. 5, 1992

[86] PCT No.: PCT/FR92/00100

§ 371 Date: May 11, 1993

§ 102(e) Date: May 11, 1993

[87] PCT Pub. No.: WO93/16347

PCT Pub. Date: Aug. 19, 1993

[51] Int. Cl.[6] ..... F41A 19/59; F41A 19/29

[52] U.S. Cl. ..... 89/27.14; 42/84; 89/27.3; 89/28.1

[58] Field of Search ..... 89/27.14, 27.3, 28.1, 89/136, 132; 42/84, 69.01

[56] References Cited

U.S. PATENT DOCUMENTS

| | | | |
|---|---|---|---|
| 1,298,887 | 4/1919 | Challenger et al. | 89/132 |
| 1,352,891 | 9/1920 | Green | 42/84 |
| 2,473,555 | 6/1949 | Weiss | 89/27.11 |
| 2,656,636 | 10/1953 | Green | 89/136 |
| 2,779,242 | 1/1957 | Willhauck | 89/24 |
| 3,283,658 | 11/1966 | Knight et al. | 42/84 |
| 4,986,019 | 1/1991 | Dennis | 42/69.01 |

FOREIGN PATENT DOCUMENTS

| | | |
|---|---|---|
| 2163932 | 7/1973 | France . |
| 2402852 | 9/1978 | France . |

*Primary Examiner*—David Brown
*Attorney, Agent, or Firm*—Oliff & Berridge

[57] ABSTRACT

A device for percussion firing of a mortar or similar comprises a translationally mobile firing pin and means for actuating it. Said firing pin is part of a firing assembly (10) housed in a casing (23) secured to the base plate (27) of the mortar (M), said firing assembly being actuated, via a firing system (16), by a firing spring (33) with interposed articulated lever (51) to which is coupled a pivot arm (54) interacting with a control unit (13) forming part of the firing system (16) and with a mobile stop (11)also secured to the rear base plate (27) of the mortar (M), designed to cooperate with a fixed part (80) of the said mortar (M).

12 Claims, 3 Drawing Sheets

16
17
63
64
65
60
51
52
53
12
50
13
54
55
45
46
35
35a
26a
10
23
33
40
26
31
32
41
30
42
11
56
27
72
70
23a
24
p
c
t
M
a

PERCUSSION IGNITION DEVICE FOR A MORTAR OR THE LIKE AND A MORTAR COMPRISING SUCH A DEVICE

BACKGROUND OF THE INVENTION

The invention concerns a firing mechanism by percussion for a mortar or similar weapon, and a mortar or similar weapon incorporating such a mechanism.

Apart from muzzle-loading mortars, there are also known to exist mortars loaded from the rear, whether from a drum-type magazine of shells, as described in FR-A-2 402 852 or from a loading chamber being moved perpendicularly to the axis of the discharge tube as described, for example, in FR-A-2 163 932. While the usual muzzle-loading mortars are equipped with a firing mechanism which simply consists of a firing-pin rigidly fixed to the baseplate of the weapon, this approach is unsuitable for the advanced mortars of the types described in the aforesaid documents, nor generally for rear-loading mortars, in which one part of the discharge tube that serves as a shell carrier is to be displaced relative to the discharge tube proper.

The problem thus arises of providing such mortars with a firing mechanism using mechanical percussion which would be at once reliable, capable of containing the pressure of the propellant gas upon discharge, and also capable of withstanding the recoil acceleration in the case of weapons equipped with an arrangement for absorbing this recoil and, finally, enabling automatic reloading upon the counter-recoil of the weapon as required, in particular, for rapid-fire mortars.

SUMMARY OF THE INVENTION

The basic problem of the invention is solved by providing a percussion-firing mechanism for a mortar or similar weapon comprising a movable firing-pin mounted on a translation carriage and an apparatus for activating this pin. The pin forms a part of a percussion assembly housed in a housing rigidly affixed to the rear baseplate of the mortar. The pin is activated by a trigger releasing a percussion spring with an interposed articulated lever on which pivots an arm which may be engaged, on the one hand, with the activating organ associated with the trigger and, on the other hand, with a movable stop assembly also rigidly affixed to the rear baseplate of the mortar. The movable stop assembly should be engaged with a fixed organ of the mortar.

According to another characteristic of the invention, the trigger is a solenoid with a rod engaging with the activation organ which includes a push-rod loaded by the return spring and has its extremity adjacent to the solenoid rod including a rocking mechanism mounted so as to pivot around an axis essentially perpendicular to the striker sliding runout.

In a preferred realization the percussion assembly includes the following:

The firing-pin proper, of circular cross-section, split into longitudinal channels movable along the first bore provided in the housing affixed to the rear baseplate of the mortar;

A piston of the same axis as the firing-pin, housed in the second bore of the housing and forming one piece with the firing-pin, these two being connected by a sealed rod that fits in the ring separating the first from the second bore;

A percussion spring pressing, on one hand, on the piston face opposed to the face turned towards the firing-pin proper and, on the other hand, against a threaded plug which forms the second bore; and The second bore containing a shock absorbing spring member of which the pre-stress may be adjusted by way of the threaded plug and which is intended to be engaged by the piston.

The invention also includes the articulated lever having one of its extremities on the connecting rod that joins the firing-pin proper with the piston, which is similarly articulated at its other extremity along the guiding jaws of the body rigidly affixed to the rear baseplate of the mortar.

The baseplate also carries the mobile stop assembly including a cocking pin mounted so as to slide against the action of a compression spring having its tension adjustable by an adjusting screw on which the articulated arm pivoted on the lever connected to the percussion assembly is intended to be supported.

According to yet other characteristic of the invention, the articulated arm fits into the bore which slides the push-rod and which is mounted on the housing rigidly affixed to the rear baseplate of the mortar in which the percussion assembly is mounted.

BRIEF DESCRIPTION OF THE DRAWINGS

The invention is covered by the following description, based on the example and referring to the drawings appended, in which.

DETAILED DESCRIPTION OF PREFERRED EMBODIMENTS

Figures 1, 4:
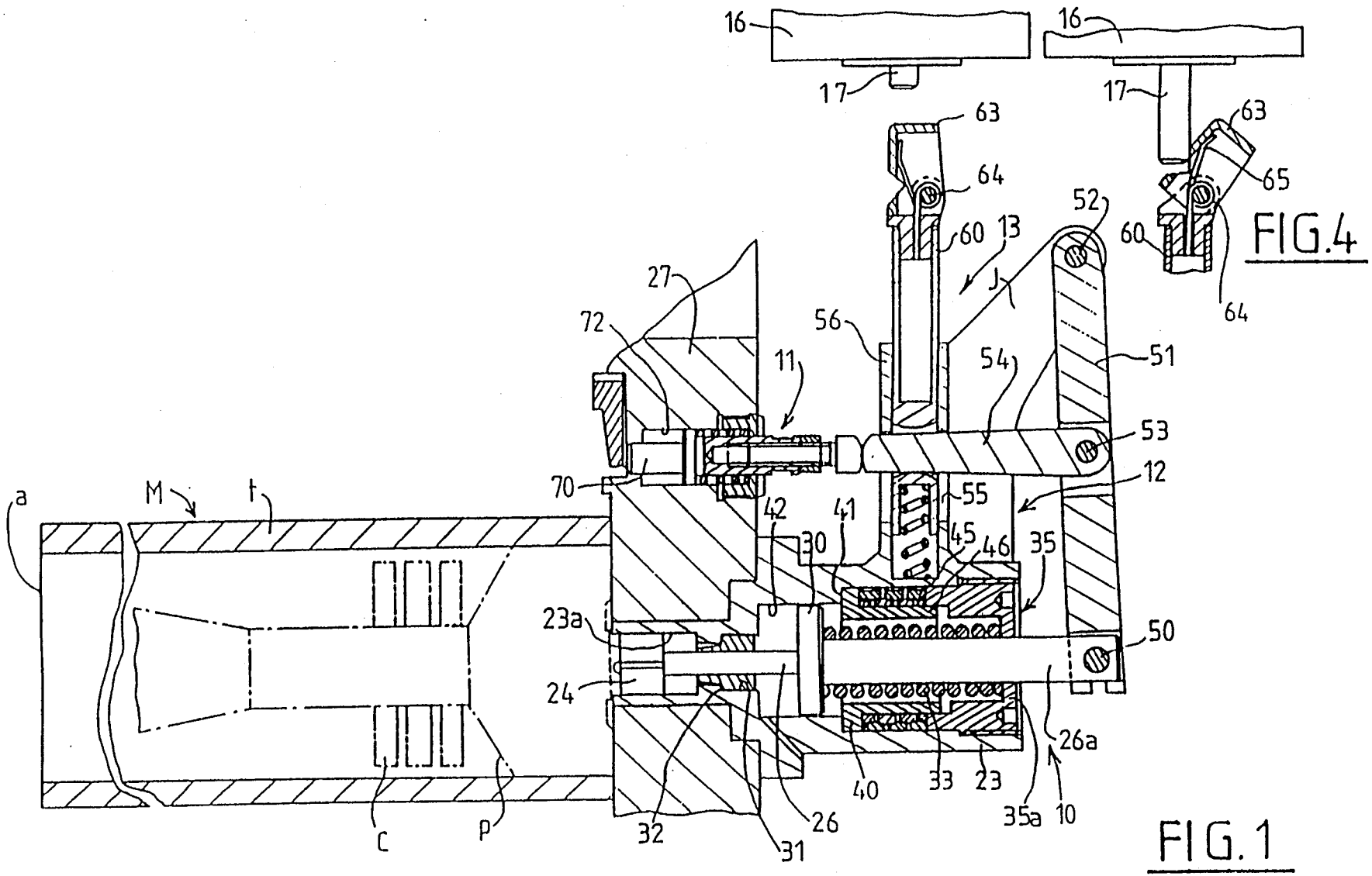
FIG. 1 is a view of the mechanism according to the invention in the initial state, before a shot is discharged.
FIG. 4 shows a detail.

A mechanism D according to the invention, for firing a shell p from a mortar M, in which p indicates the rear extremity of the discharge tube—opposed to the muzzle a—and which is of one piece with the rest of the tube or, more generally, movable relative to the discharge tube, includes the percussion assembly pin, the mobile stop assembly 11, the means of activation 12 of the percussion assembly 10 and the activation organ 13 of the means 12 which is operated with the aid of the trigger comprising in this case the solenoid 16 and the rod 17.

The percussion assembly 10 is housed in the housing 23 fixed to the rear baseplate 27 of the mortar M and, by virtue of this, shares the recoil movement of the weapon when it is fired, in as much as this recoil is manifested. As is plainly seen in FIGS. 1 and 3, the housing 23 is provided in its front tubular part **23*b* with a first bore 23*a* in which is mounted a sliding firing-pin 24 having its front face 24*a* provided with the percussion point 24*b*. FIG. 5 shows the circular cross-section of the firing-pin being circular and sliced into 4 longitudinal channels $\mathbf{25}_1$, $\mathbf{25}_2$, $\mathbf{25}_3$, and $\mathbf{25}_4$ equally distributed over the circumference and which stretch over the entire length of the firing-pin. The firing-pin is affixed on the rod 26 coaxial with the axis A of the tube t. The rod 26, which carries the piston 30, slides near the rear extremity of the bore 23*a* in a sealing and guiding ring 18, mounted in the facing 31 of the part 23*b* of the housing 23 and which presses against the shoulder 32 of the part. A percussion spring 33 presses the face piston 30 opposed to the face turned toward the firing-pin 24. The percussion spring 33 encircles the part of largest diameter 26***a* of the rod 26 which passes through the threaded plug 35 at the rear extremity of the housing 23. The end 35*a* of plug 35 comes out through the stop of the spring 33. Spring 33 is in part encircled by the ring 40 resting on the shoulder 41 of a second bore 42—of larger diameter than the bore 23*a*—provided in the rear part of the housing 23, the ring 40 serving to guide as well as to stop by piling up the shock-absorbing springs 45 whose pre-stressed state may be adjusted with the help of the threaded plug 35. Threaded plug 35 caps the ring 40 by its cylindrical-end surface 46. At the rear extremity of the rod 26*a* there is mounted an articulated lever 51 on the pivot 50, which lever is also articulated at its other extremity on the pivot 52 mounted in the jaws J which support the housing 23 and between which the arm 54 may be displaced as it swings on the lever 51 around the pivot 53 located between the pivots 50 and 52. Arm 54 is guided in the opening 55 of the bore 56 set up on the housing 23 and directed essentially perpendicularly to the axis of the bores 23*a* and 42, being positioned about halfway along the latter.

Figure 3:
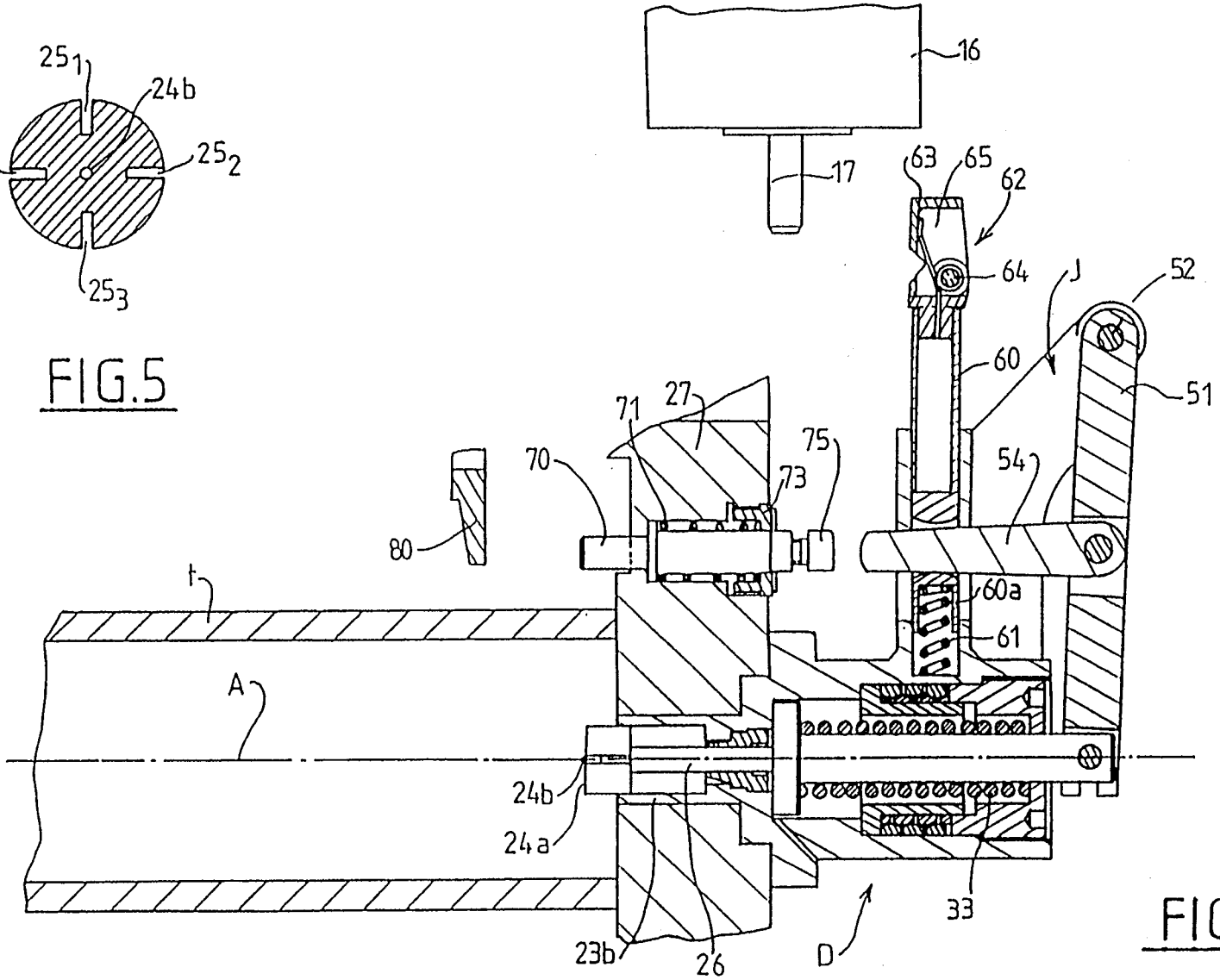
FIG. 3 shows a view similar to that of FIG. 2 but for another state of the mechanism.

Within the bore 56 is mounted in sliding fit the push-rod 60 of which the extremity 60*a* (the extremity nearest the housing 23) is hollowed to accept the compression spring 61, FIG. 3, that presses at its other extremity against the bottom of the bore 56. The push-rod 60 carries at its other extremity a rocking mechanism 62 comprising a tab 63 swinging on the pivot 64 against the action of the piano-wire spring 65, FIG. 4.

Figure 2:
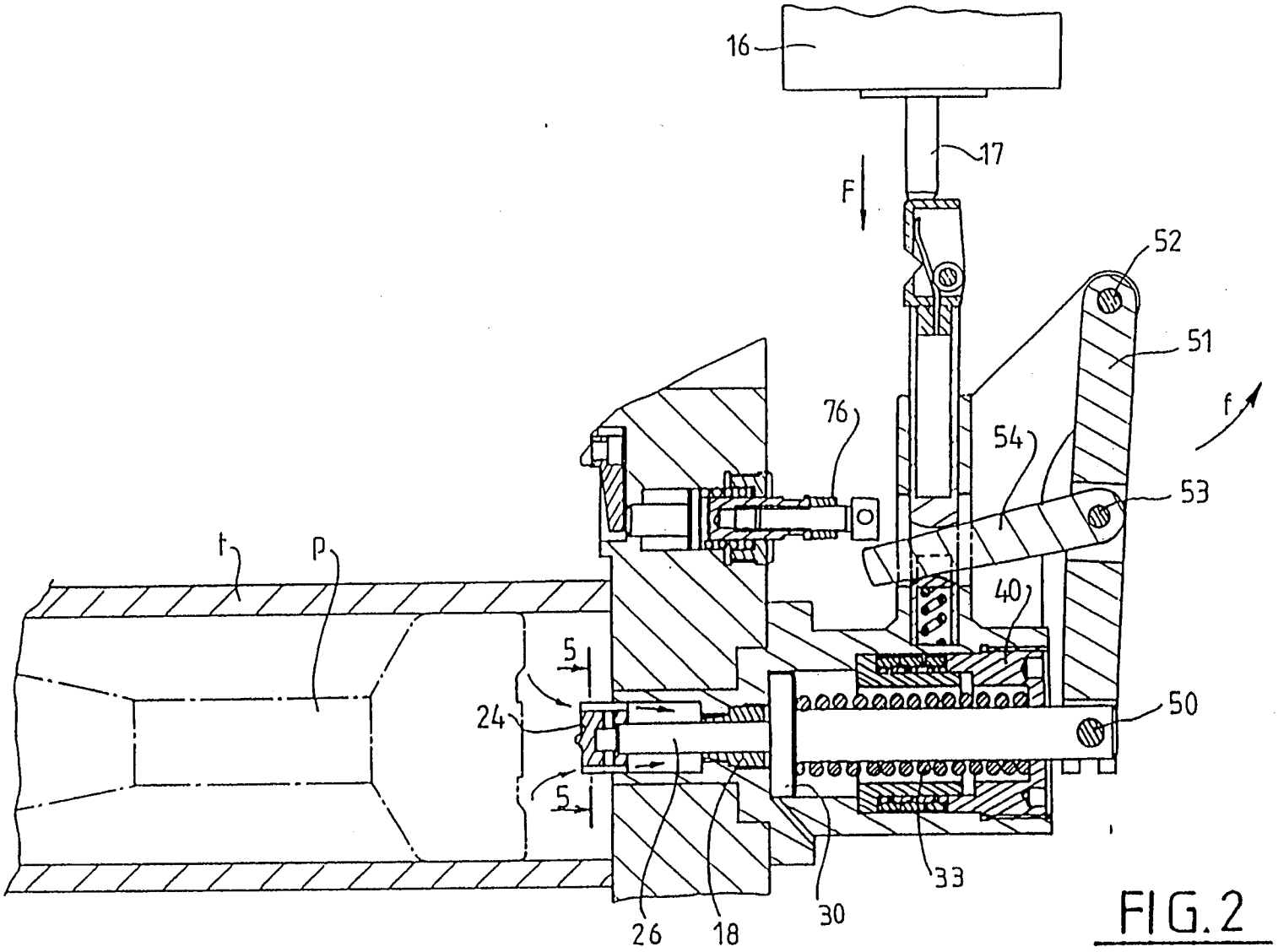
FIG. 2 shows the corresponding view but after the discharge of a shot.

Apart from the percussion assembly 10, the means 12 and the organ 13 already described, the mechanism D also comprises the movable stop assembly 11 comprising the arming pin 70 mounted in sliding fit in the baseplate 27 of the mortar and on which is exerted the action of the compression spring 71 housed in the recess 72 of the baseplate 27. The recess is blocked over the rear face of the baseplate 27 by a nut 73 engaged by the adjustment screw 75. Adjustment screw 75 is engaged with a counter-nut 76 serving to adjust the retraction of the firing-pin 24. A fixed plate 80, provided in front of the movable stop assembly is intended to engage and draw the arming pin 70 against the action of the spring 71, from its position indicated in FIG. 3 to that indicated in FIGS. 1 and 2, as is explained in detail in the following description of the functioning of the mechanism according to the present invention.

Figure 5:
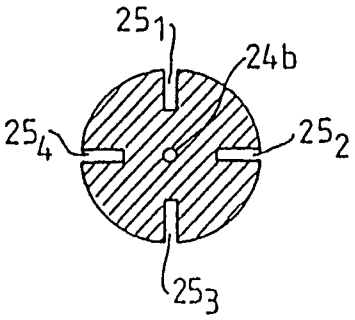
FIG. 5 shows the section 5—5 marked on FIG. 2, but on a larger scale.

In its initial condition, the firing mechanism is as shown in FIG. 1, wherein the firing-pin 24 is inside the bore 23*a* and the percussion point 24*b* does not extend into the tube t into which the shell p has been introduced. When the solenoid 16, bolted to a fixed part of the weapon, is actuated, its rod 17 is freed to pass over from the state shown in FIG. 1 to that shown in FIG. 2 in which it presses against the tab 63 and displaces the push-rod 60 in the direction of the arrow F, causing the arm 54 to swing downwards (in the figure), this arm having been in contact with the screw 75 and with the movable stop assembly 11, and which now releases them. The percussion spring 33, which was cocked in the initial state, is now released and kicks forward the firing-pin 24 through the intermediary of the rod 26 which is joined to it.

The primer of the cartridge with which the shell p is equipped then ignites the charge or charges c associated with the shell p which as they burn generate the gas which propels the shell. This propellant gas, confined between the walls of the tube t, the baseplate 27 of the mortar and the shell p causes the shell to be ejected. The propellant gas penetrates in part, passing through the channels 25, into the chamber formed by the bore 23*a*, the rear face of the firing-pin 24 and the sealing ring 18. The sealing ring 18 is preferably a ring with a lip made of corrosion-resistant material, such as the materials used in valve-guides of motorcar engines.

In case the shell p carries a reduced charge c, then whatever the propellant cartridge, the pressure of the gas generated is low and the weapon does not recoil, or recoils only slightly. The pressure force exerted on the front face 24*a* of the firing-pin 24 is then higher than that exerted on the rear face of the firing pin, due to the presence of the rod 26, so that the firing pin and the rod joined to it recoil from the position shown in FIG. 2, and compress the compression spring 33. The lever 51 turns on the pivot 52 in counter-clockwise sense, as shown by the arrow f, thus freeing the arm 54 from the screw 75 of the movable stop assembly. The spring 61 having been compressed at the release of the solenoid (its rod having been retracted meanwhile) then brings back the arm 54 to press against the screw 75, that is, returns it again to the state shown in FIG. 1, so that the next munition may be fired.

In the opposite case, if the munition or shell p is equipped with a high charge c, then upon firing as described, the propellant gas generated exerts a high pressure which causes, a recoil of the weapon, as shown in FIG. 3. The high pressure, however, also causes a displacement of the rod 26 and of the piston 30 joined to it. The displacement is of greater amplitude than in the preceding case, and it brings the piston to press upon the ring 40 and to slightly displace the ring thereby compressing the shock-absorbing springs 45.

The shock absorbing springs 45 provide the function of dissipating and absorbing some of the kinetic energy of the percussion assembly, of the lever 51 and of the arm 54 associated with it. When the propellant gas pressure has diminished sufficiently, the compression spring 33, on the one hand, and the shock-absorbing springs 45, on the other hand, return the percussion assembly, the lever 51 and the arm 54 to the position shown in FIG. 3 whereby the firing-pin 24 protrudes into the firing chamber of the discharged tube t. Upon recoil, the pin 70 of the movable stop assembly 11 which is no longer arrested by the plate 80, is displaced forwards, under the action of the screw 71, taking the spring 75 out of reach of the arm 54 that is therefore essentially aligned with the pin 70 (i.e. it assumes the position shown in FIG. 3 to whioh it was brought by the push rod 60—which at the start of recoil escaped the rod 17 of the solenoid 16—and which is thus subject to the action of the spring 61, previously placed under tension, as explained in the aforesaid, upon firing the shot).

Whereupon, starting from the state shown in FIG. 3—which is the state at the end of the recoil stage and when the counter-recoil is about to start—the entire movable assembly is once more displaced forwards (under the action of means not shown and which are associated with the mortar) the pin 70 comes to rest against the fixed plate 80 and then the pin is displaced in a sliding motion towards the rear of the weapon to cause the corresponding motion of the arm 54. The arm then swings on the pivot 52 and on the pivot 50 to retract the firing-pin 24 into its hidden state, simultaneously compressing the percussion spring 33. The state obtained is once more the one shown in FIG. 1, in which the weapon is ready to fire the next munition, whether the munition is provided with a strong or a weak propelling charge, so that the mechanism D according to the invention operates, as explained in the aforegoing, independently of the amount of charge utilized, that is, whether it is strong, weak, and even when the weapon does not recoil at all.

Other factors that contribute to the proper functioning of the mechanism according to the invention are the fact that the tab 63 is mounted at the extremity of the push rod 60 by means of a rocking mechanism which, as shown in FIG. 4, permits the push rod, and consequently the entire mechanism, to regain the armed position, even in case the rod 17 of the solenoid has not been retracted into its inoperative state at the end of the counter-recoil. This is achieved very simply by the swinging movement on the pivot 64 against the action of the spring 65 with the result that the tab is returned to its state permitting another shot to be fired.

I claim:

1. A percussion firing mechanism, comprising:

a housing;

a percussion assembly disposed within said housing and comprising an actuatable firing-pin, said housing being fixable to a baseplate, wherein said firing-pin is fixed to a plunger movably disposed within said housing between a pre-actuated position and an actuated position relative to said housing, a percussion spring being disposed around said plunger and urging said plunger to achieve said actuated position;

a trigger unit comprising a solenoid and a rod, said solenoid activating said rod to shift between a first position and a second position;

a deflecting mechanism adapted to be moved between a first position and a second position by said rod of said trigger unit, said first and second positions of said rod corresponding to said first and second positions of said deflecting mechanism;

a movable stop assembly fixed to said baseplate; and a rigid bar member in actuatable engagement with said firing-pin, wherein a pivotable arm is attached to said rigid bar member at an intermediate portion of said rigid bar, said pivotable arm engaging said deflecting mechanism and said movable stop assembly, wherein said pivotable arm engaging said movable stop assembly maintains said plunger in said pre-actuated position against the force of said percussion spring, wherein when said solenoid activates said rod, thereby moving said rod and said deflecting mechanism to their respective second positions, said pivotable arm is disengaged from said movable stop assembly causing said plunger to achieve said actuated position by the force of said percussion spring.

2. A percussion firing mechanism, comprising:

a housing;

a percussion assembly disposed within said housing and comprising a firing-pin actuatable between a pre-actuated position and an actuated position relative to said housing, said housing being fixable to a baseplate, said firing-pin being urged by an urging device disposed within said housing to achieve said actuated position;

a trigger unit;

a deflecting mechanism adapted to be moved between a first position and a second position by said trigger unit;

a movable stop assembly fixable to said baseplate; and a rigid bar member in actuatable engagement with said firing-pin, a pivotable arm being attached to said rigid bar member, said pivotable arm engaging said deflecting mechanism and said movable stop assembly, wherein said pivotable arm engaging said movable stop assembly maintains said firing-pin in said pre-actuated position.

3. A percussion firing mechanism according to claim 2, wherein said rigid bar member is pivotally attached to a supporting member, said supporting member supporting said housing.

4. A percussion firing mechanism according to claim 2, wherein said movable stop member comprises an arming pin adapted to slide between a first position and a second position within a bore in said baseplate, said arming pin being urged towards said first position by a compression spring disposed between an end of said bore and a nut engaged by an adjustment screw, said adjustment screw engaging said pivotable arm attached to said rigid bar member.

5. A percussion firing mechanism according to claim 2, wherein said firing pin has a circular cross-section and comprises a plurality of longitudinal channels, said firing-pin being movable within a first bore within said housing relative to said housing, said percussion assembly further comprising:

a piston coaxial with said firing-pin and movable in a second bore in said housing relative to said housing, said piston being attached to said firing-pin by a piston rod, wherein a sealing ring is disposed between said first and second bores in said housing, said piston rod being guided by said sealing ring, said rigid bar member being pivotally attached to said firing-pin at one end of said piston rod; and a percussion spring disposed around said piston rod between said piston and a threaded plug, said threaded plug closing said second bore of said housing, wherein said percussion spring urges said firing-pin to achieve said actuated position.

6. A percussion firing mechanism according to claim 5, wherein said percussion assembly further comprises a shock-absorbing spring disposed within said second bore of said housing, said shock-absorbing spring being adjustably prestressed by said threaded plug.

7. A percussion firing mechanism according to claim 2, wherein said trigger unit comprises a solenoid and a rod, said solenoid being configured to actuate said rod to shift between a first position and a second position, said first and second positions of said rod corresponding to said first and second positions of said deflecting mechanism.

8. A percussion firing mechanism according to claim 7, wherein said deflecting mechanism comprises a push rod movably disposed within a bore between said first and second positions, said push rod being urged toward said first position by a spring disposed in said bore at a first end of said push rod.

9. A percussion firing mechanism according to claim 8, wherein said deflecting mechanism further comprises a rocking mechanism pivotally attached to a second end of said push rod, said rocking mechanism being pivotable between a first and second position and urged toward said first position by a spring, wherein said rocking mechanism enables said deflecting mechanism to be realigned with said trigger unit even if said rod of said trigger unit has not been retracted.

10. A percussion firing mechanism according to claim 8, wherein said pivotable arm engages said deflecting mechanism in an opening therein, said opening being in said bore in said deflecting mechanism and perpendicular thereto.

11. A mortar having a percussion firing mechanism, the percussion firing mechanism comprising:

a housing;

a percussion assembly disposed within said housing and comprising a firing-pin actuatable between a pre-actuated position and an actuated position relative to said housing, said housing being fixable to a baseplate, said firing-pin being urged by an urging device disposed within said housing to achieve position;

a trigger unit;

a deflecting mechanism adapted to be moved between a first position and a second position by said trigger unit;

a movable stop assembly fixable to said baseplate; and a rigid bar member in actuatable engagement with said firing-pin, a pivotable arm being attached to said rigid bar member, said pivotable arm engaging said deflecting mechanism and said movable stop assembly, wherein said pivotable arm engaging said movable stop assembly maintains said firing-pin in said pre-actuated position.

12. A mortar having a percussion firing mechanism, the percussion firing mechanism comprising:

a housing;

a percussion assembly disposed within said housing and comprising an actuatable firing-pin, said housing being fixable to a baseplate, wherein said firing-pin is fixed to a plunger movably disposed within said housing between a pre-actuated position and an actuated position relative to said housing, a percussion spring being disposed around said plunger and urging said plunger to achieve said actuated position;

a trigger unit comprising a solenoid and a rod, said solenoid activating said rod to shift between a first position and a second position;

a deflecting mechanism adapted to be moved between a first position and a second position by said rod of said trigger unit, said first and second positions of said rod corresponding to said first and second positions of said deflecting mechanism;

a movable stop assembly fixed to said baseplate; and a rigid bar member in actuatable engagement with said firing-pin, wherein a pivotable arm is attached to said rigid bar member at an intermediate portion of said rigid bar, said pivotable arm engaging said deflecting mechanism and said movable stop assembly, wherein said pivotable arm engaging said movable stop assembly maintains said plunger in said pre-actuated position against the force of said percussion spring, wherein when said solenoid activates said rod, thereby moving said rod and said deflecting mechanism to their respective second positions, said pivotable arm is disengaged from said movable stop assembly causing said plunger to achieve said actuated position by the force of said percussion spring.

* * * * *